United States Patent [19]

Martino

[11] 4,236,271

[45] Dec. 2, 1980

[54] BRUSH ATTACHMENT FOR TENNIS RACKET

[76] Inventor: Ronald T. Martino, 5305 Ehrlich Rd., Tampa, Fla. 33624

[21] Appl. No.: 30,904

[22] Filed: Apr. 17, 1979

[51] Int. Cl.[3] ..... A47L 25/00; A63B 49/00

[52] U.S. Cl. ..... 15/246; 273/73 R

[58] Field of Search ..... 15/246; 273/73 R

[56] References Cited

U.S. PATENT DOCUMENTS

| | | | |
|---|---|---|---|
| 3,349,422 | 10/1967 | Heil | 15/246 X |
| 3,874,666 | 4/1975 | Ross | 273/73 R |

FOREIGN PATENT DOCUMENTS

| | | | |
|---|---|---|---|
| 2533233 | 2/1977 | Fed. Rep. of Germany | 273/73 R |

*Primary Examiner*—Christopher K. Moore

*Attorney, Agent, or Firm*—Clarence A. O'Brien; Harvey B. Jacobson

[57] ABSTRACT

A brush attachment for a tennis racket including a plurality of bristles embedded in a flexible body member having a channel formed therein for fitting over and conforming to the shape of a tennis racket bow. A strap is removably attached to each end of the body for holding the brush onto the tennis racket bow.

3 Claims, 3 Drawing Figures

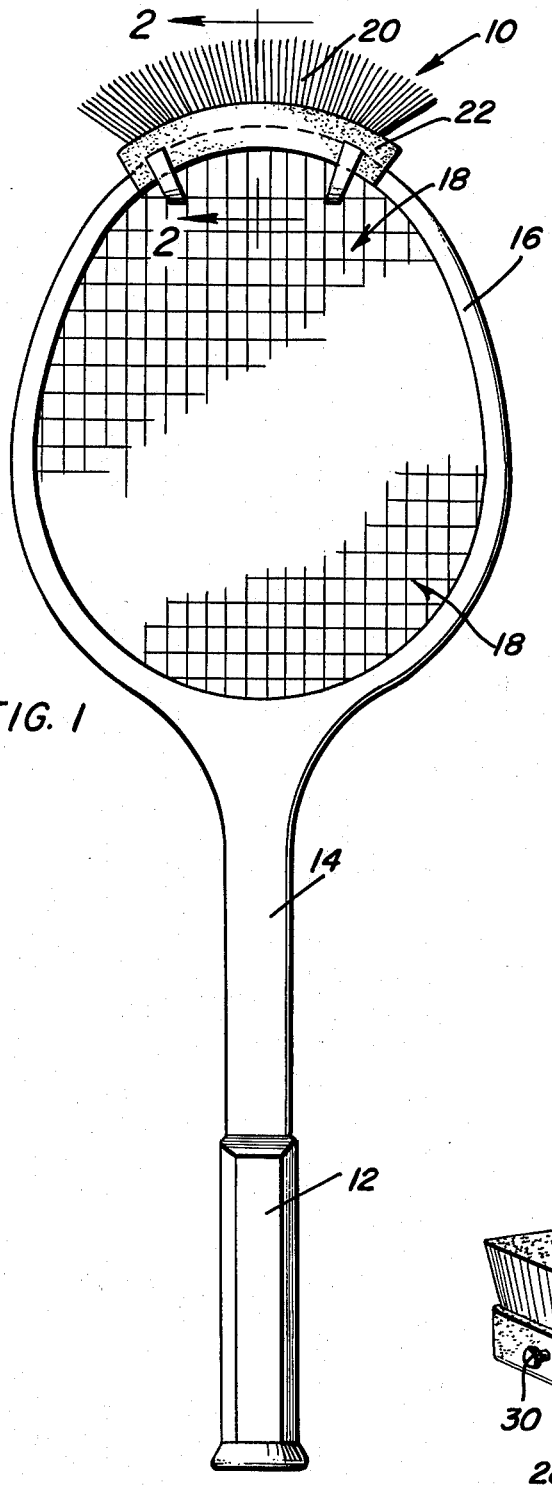
FIG. 1
FIG. 2
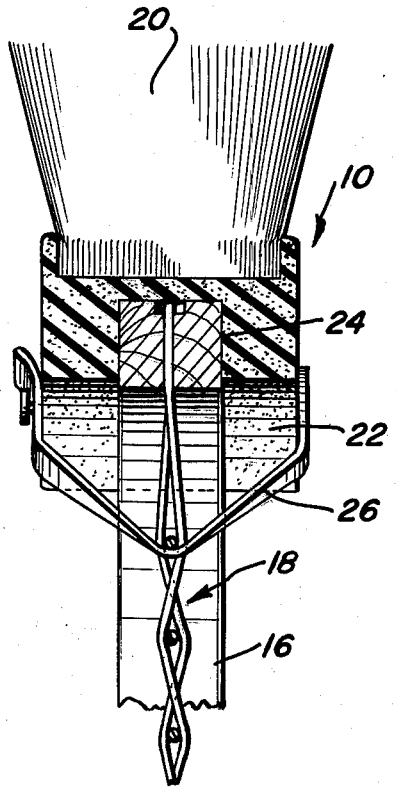
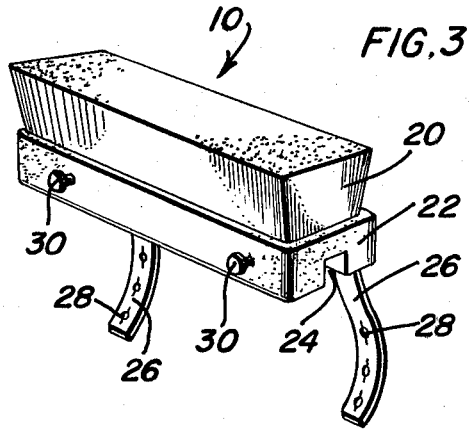
FIG. 3

BRUSH ATTACHMENT FOR TENNIS RACKET

BACKGROUND OF THE INVENTION

1. Field of the Invention

This invention relates to attachments for tennis rackets and especially to such attachments which are adapted for sweeping the lines of a tennis court.

2. Description of Related Art

When playing tennis, it is often necessary to use the marks produced by the tennis ball on or near the boundary lines of the court, especially clay courts, to determine whether a shot is "in" or "out". A brush must be maintained in the vicinity of the players in order to allow the lines to be cleaned easily and rapidly during breaks in the game. For this reason, a need has developed for a simple brush mechanism which can be maintained on or about the tennis player in order to facilitate the cleaning of these lines.

Certain attachments for sporting equipment have been suggested in the past. For example, U.S. Pat. No. 2,739,331, issued Mar. 27, 1956 to Goodman shows a golf culb attachment comprising a brush which is inserted in the handle end of the golf club for cleaning debris off greens and the like. U.S. Pat. No. 3,349,422, issued Oct. 31, 1967 to Heil, also shows a green sweeping brush attachment for a golf club. The Heil device includes a central opening which is to be disposed over the head of a putter. A plurality of bristles extend downwardly therefrom for cleaning the green. U.S. Pat. No. 4,088,320, issued May 9, 1978 to Brock shows a tennis racket attachment which includes a pair of resilient retaining members releasably positioned on the frame of the racket and arranged to receive a tennis ball resting on a court or other surface.

SUMMARY OF THE INVENTION

The present invention includes a substantially rectangular body member made of rubber or other flexible material. The body has a longitudinally extending rectangular groove disposed therein, the width of which is equivalent to the thickness of the bow of a tennis racket. Embedded in the body are a plurality of bristles which extend away from the body on the side opposite the channel. A pair of straps are attached with one strap being connected at each end of the body. The straps are threaded around one of the strings of the racket and the free ends of the straps are attached to male members which extend from the body. In this manner, the body is disposed about the top of the bow of the racket and conforms to the shape thereof for producing a firm engagement between the brush and the racket thereby allowing a player to sweep the lines of the tennis court during breaks in play.

Accordingly, one object of the present invention is to provide a novel brush attachment for tennis rackets which can be used to clean the lines of tennis courts during a game of tennis.

A further object of the present invention is to provide a novel brush attachment for tennis rackets which can be easily attached to or disengaged from the bow of a tennis racket.

Yet a still further object of the present invention is to provide a novel brush attachment for tennis rackets which is adapted to fit a plurality of bow shapes in that the body of the brush is flexible and can conform to the shape of any tennis racket.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is an elevational view of a tennis racket connected to the brush attachment.

FIG. 2 is an elevational view taken substantially along a plane passing through section line 2—2 of FIG. 1.

FIG. 3 is a perspective view of the brush attachment of the present invention.

DESCRIPTION OF THE PREFERRED EMBODIMENT

Now with reference to the drawings, the brush attachment for tennis rackets generally referred to by the numeral 10 will be described in detail. With specific reference to FIG. 1 there will be seen a standard tennis racket which includes a grip 12 connected to a shank 14 which is itself connected to bow 16 which has strings 18 threaded therethrough. As is clearly evident in FIG. 1, the brush attachment 10 is arcuately bent to fit around the bow 16 and conforms to the shape thereof. Bristles 20 extend radially away from the body 22 and can be used for sweeping the lines of clay or other tennis courts clean by merely using the grip 12 as a handle for the brush and holding the tennis racket in a depending position with the bristles contacting the ground.

With reference to FIGS. 1–3, it can be seen that the brush attachment itself comprises body 22 which is made from rubber or any other suitable resilient material so that the body can conform to the shape of the bow 16 of any given tennis racket. As is well known, the bows of tennis rackets may have slightly different shapes and radii of curvature. In order to stabilize the body 22 on the bow 16, a generally rectangular channel 24 is formed in the body and the bow 16 is inserted therein. The width of channel 24 should conform to the thickness of the bow itself. The thickness of the bows of tennis rackets may vary slightly. However, the resilient body can be flexed so that channel 24 can be pulled tightly against the sides of the bow thus forming a firm frictional engagement therewith. In order to hold the body onto the bow in this tight engagement, a pair of straps 26 is connected to the body. One strap is attached at each end of the body and both straps are fixedly connected to one side thereof. Each strap contains a plurality of adjustment holes 28 which cooperate with male connectors 30 for holding the body onto the tennis racket bow. As can easily be understood, the straps will pull the longitudinal extent of the body into a generally arcuate shape concentric with the bow 16 and at the same time the straps can pull the sides of the channel 24 together pressing them against the sides of the bow. In this manner, the brush is firmly held against the bow on all three sides of the channel. It will be noted that the straps 26 can be threaded around the bow 16 itself or can be threaded past individual strings 18 for producing sufficient downward force to hold the body on the bow.

Extending away from the body 22 on the opposite side of the body from channel 24 are a plurality of bristles 20. The bristles can be made from any suitable material such as nylon or the like and are embedded in the body 22 and firmly affixed thereto by means of gluing or any other suitable attachment means.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A brush attachment for tennis rackets comprising: a body portion formed from a resilient material for allowing said body portion to conform to the arcuate shape of a tennis racket bow; a plurality of bristles extending from said body portion; attachment means connected to said body for attaching said body to the bow of a tennis racket; wherein a longitudinally extending channel is formed in said body portion for partially surrounding a tennis racket bow when the body portion is held in engagement therewith, said channel being formed on the side of said body portion opposite that from which said bristles extend.

2. The structure of claim 1 wherein said attachment means comprises at least two straps extending from said body and adapted to pass through a tennis racket bow for attaching said body thereto.

3. In combination with a tennis racket having a grip, shank end and a bow; a brush attachment having a flexible body portion for conforming to the shape of said bow; attachment means for holding said body portion on said bow; and bristles connected to said body and extending away from said body in a direction opposite to said grip.

* * * * *